US010487842B2

(12) United States Patent
Jin

(10) Patent No.: US 10,487,842 B2
(45) Date of Patent: Nov. 26, 2019

(54) APPARATUS FOR SUPPRESSING SURGE OF TURBO COMPRESSOR

(71) Applicants: Hyundai Motor Company, Seoul (KR); Kia Motors Corporation, Seoul (KR)

(72) Inventor: Seok Beom Jin, Gyeonggi-Do (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 105 days.

(21) Appl. No.: 15/826,024

(22) Filed: Nov. 29, 2017

(65) Prior Publication Data

US 2019/0093664 A1 Mar. 28, 2019

(30) Foreign Application Priority Data

Sep. 25, 2017 (KR) ..... 10-2017-0123673

(51) Int. Cl.

| | |
|---|---|
| ***F04D 27/02*** | (2006.01) |
| ***F04D 17/10*** | (2006.01) |
| ***F04D 29/28*** | (2006.01) |
| ***F04D 29/30*** | (2006.01) |
| ***F04D 29/42*** | (2006.01) |

(52) U.S. Cl.

CPC ..... *F04D 27/0246* (2013.01); *F04D 17/10* (2013.01); *F04D 29/284* (2013.01); *F04D 29/305* (2013.01); *F04D 29/4206* (2013.01)

(58) Field of Classification Search

CPC ..... F04D 27/0246; F04D 27/0253; F04D 27/0269; F04D 29/002

USPC ..... 415/185

See application file for complete search history.

(56) References Cited

U.S. PATENT DOCUMENTS

| | | | | |
|---|---|---|---|---|
| 2007/0214787 | A1* | 9/2007 | Noelle | F02B 37/24 60/602 |
| 2016/0146099 | A1* | 5/2016 | Mohtar | F02B 37/22 415/160 |
| 2016/0265424 | A1 | 9/2016 | Tingaud et al. | |

FOREIGN PATENT DOCUMENTS

| | | | |
|---|---|---|---|
| DE | 102010026176 | A1 | 1/2012 |
| DE | 102014007229 | A1 | 11/2015 |
| KR | 10-1184465 | B1 | 9/2012 |

OTHER PUBLICATIONS

Extended European Search Report for European Patent Application No. 17204878, dated Jul. 11, 2018, 8 pages.

* cited by examiner

*Primary Examiner* — Carlos A Rivera
*Assistant Examiner* — Jason Mikus
(74) *Attorney, Agent, or Firm* — Mintz Levin Cohn Ferris Glovsky and Popeo, P.C.; Peter F. Corless

(57) ABSTRACT

An apparatus for suppressing a surge of a turbo compressor is provided. The apparatus includes a compressor housing having a compressor wheel provided therein and an inlet having air flowing thereinto and protruding from a first opposite to the compressor wheel. A connection module has a first side connected to the compressor housing to communicate with the inlet and a second side that includes an inlet for supplying air. A flexible cone of an elastic material is disposed in the connection module and is formed in a conical shape having sizes of cross-sectional areas of a first side and a second side that are different from each other. A spring member is coupled to an exterior circumferential surface of the flexible cone to provide an elastic force and operated to change a size of a cross-sectional area of the first or second side of the flexible cone.

5 Claims, 6 Drawing Sheets

APPARATUS FOR SUPPRESSING SURGE OF TURBO COMPRESSOR

CROSS REFERENCE TO RELATED APPLICATION

The present application claims priority to Korean Patent Application No. 10-2017-0123673 filed on Sep. 25, 2017, the entire contents of which are incorporated herein for all purposes by this reference.

BACKGROUND

Technical Field of the Disclosure

The present disclosure relates to an apparatus for suppressing a surge of a turbo compressor, and more particularly, to an apparatus for suppressing a surge of a turbo compressor capable of effectively improving a surge generated at a compressor side of a turbocharger.

Description of Related Art

Generally, a supply of air to an engine at a pressure greater than an atmospheric pressure in a vehicle is called supercharging, and a substantial amount of air may be charged even in the engine having the same displacement volume due to the supercharging. As a result, when a fuel injection amount is increased, an output of the engine is improved. The turbocharger is an apparatus that supplies an increased amount of air into a combustion chamber of the engine using speed energy of exhaust gas generated from the engine to increase the output of the engine. For example, when an increased amount of air is delivered to the combustion chamber using the exhaust gas, a turbine is configured to rotate by the exhaust gas to operate a compressor. The compressed air that is generated from the compressor is supplied to a cylinder of the engine to increase the amount of air supplied to the cylinder and a fuel amount increases to improve the output of the engine.

However, since the conventional turbocharger does not control a flow rate after a compressor case of the compressor is manufactured, the turbocharger is limited in use in a surge region (e.g., alpine region, or the like) where air is not supercharged. Therefore, compressor wheels of various specifications are necessary to secure a surge margin of a highland (e.g., alpine region). Accordingly, the generation of noise due to the occurrence of the surge is severe and the compressor wheel is damaged.

The matters described as the related art have been provided for assisting in the understanding for the background of the present disclosure and should not be considered as corresponding to the related art known to those skilled in the art.

SUMMARY

Accordingly, the present disclosure provides an apparatus for suppressing a surge of a turbo compressor capable of variably controlling a flow rate of air introduced into a compressor of a turbocharger and more effectively suppressing a backflow phenomenon of air that may occur therein.

In an aspect of an exemplary embodiment of the present disclosure, an apparatus for suppressing a surge of a turbo compressor may include a compressor housing having a compressor wheel disposed therein and an inlet having air flowing thereinto and protruding from a side opposite to the compressor wheel, a connection module having a first side connected to the compressor housing to communicate with the inlet and a second side disposed with an inlet for supplying air, a flexible cone of an elastic material disposed in the connection module and formed in a conical shape in which sizes of cress-sectional areas of a first side and a second side are different from each other and a spring member coupled to an exterior circumferential surface of the flexible cone to provide an elastic force and operated to change a size of a cress-sectional area of the first or second side of the flexible cone.

In some exemplary embodiments, a first side of the flexible cone, having a relatively smaller cross-sectional area than the second side, may communicate with the inlet of the compressor housing and a second side thereof may be coupled to the inlet of the connection module, and a size of the cross-sectional area of the first side may be less than that of the inlet of the compressor housing. The compressor housing may include a coupling aperture that protrudes while surrounding the inlet and the connection module may have an exterior circumferential surface disposed in an interior side of the coupling aperture of the compressor housing connected to the compressor housing.

In other exemplary embodiments, the connection module may include a selectively rotatable rotary member formed to have a first side and a second side having different cross-sectional areas, the first side having a smaller cross-sectional area than the second side being connected to the inlet of the compressor housing and an exterior circumferential surface of the second side being disposed in the coupling aperture and a fixing member maintaining a fixed state and having a first side selectively rotatably coupled to a second side of the rotary member and the second side includes the inlet.

Additionally, the rotary member may include a locking portion to lock a first end of the spring member, a second end of the spring member may be coupled to the inlet of the fixing member together with the flexible cone, and an intermediate portion thereof may be coupled to the exterior circumferential surface of the flexible cone. The locking portion of the rotary member may include the protrusion that protrudes in a radial direction, and thus when the first end of the spring member is expanded while being positioned at the protrusion by the rotation of the rotary member, the cross-sectional area of the first side of the flexible cone may be equal to that of the inlet of the compressor housing.

The compressor housing may include a first aperture disposed on a side wall thereof on which the inlet is formed and may be configured to guide air on the compressor wheel side to a chamber formed from the coupling aperture and the rotary member, an exterior circumferential surface of the rotary member may be formed with a second aperture, and the exterior circumferential surface of the flexible cone may be formed with a third aperture to re-circulate air. The second aperture of the rotary member and the third aperture of the flexible cone may not be aligned with each other. A sealing member may be disposed between an exterior circumferential surface of the fixing member and an interior side surface of the coupling aperture.

BRIEF DESCRIPTION OF THE DRAWINGS

The above and other objects, features and advantages of the present disclosure will be more clearly understood from the following detailed description taken in conjunction with the accompanying drawings, in which.

DETAILED DESCRIPTION

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

Although exemplary embodiment is described as using a plurality of units to perform the exemplary process, it is understood that the exemplary processes may also be performed by one or plurality of modules. Additionally, it is understood that the term controller/control unit refers to a hardware device that includes a memory and a processor. The memory is configured to store the modules and the processor is specifically configured to execute said modules to perform one or more processes which are described further below.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Figure 1:
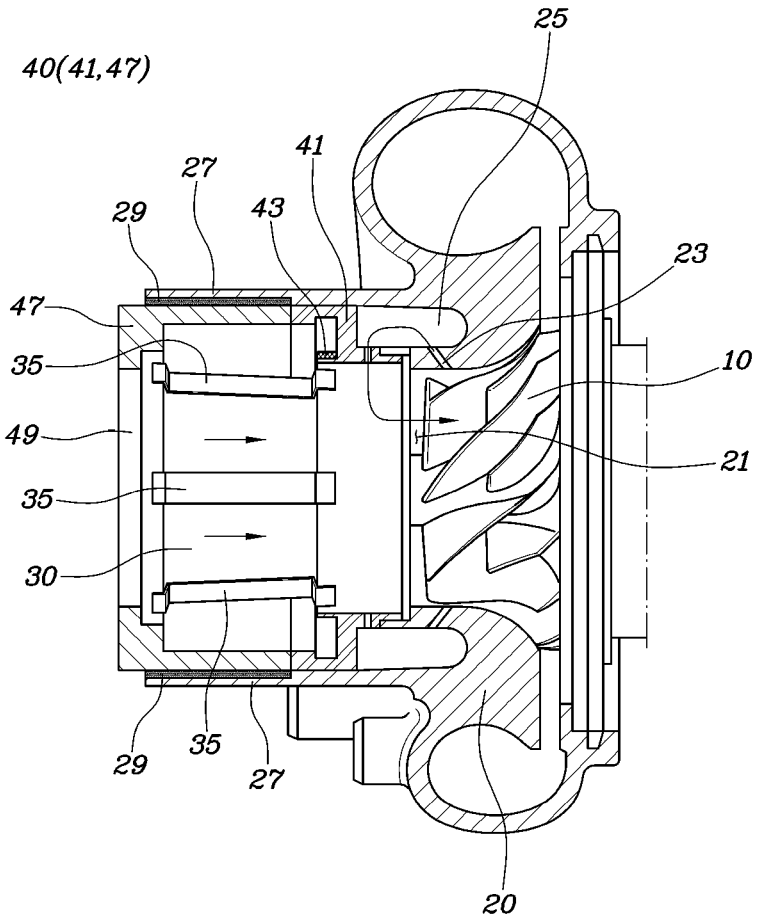
FIG. 1 is an exemplary cross-sectional view illustrating a side shape of an apparatus for suppressing a surge of a turbo compressor according to an exemplary embodiment of the present disclosure when the apparatus for suppressing a surge of a turbo compressor is operated.
Figure 2:
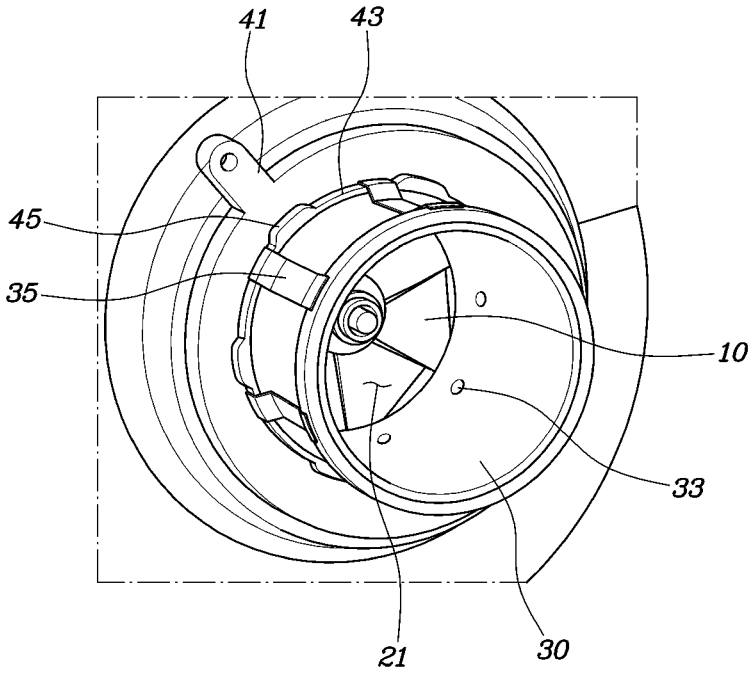
FIG. 2 is an exemplary perspective view illustrating an operation of a spring member when the apparatus for suppressing a surge of a turbo compressor according to an exemplary embodiment of the present disclosure is operated.
Figure 3:
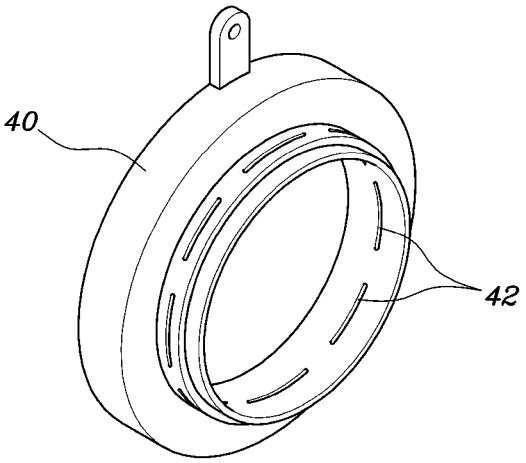
FIG. 3 is an exemplary diagram illustrating a rotary member according to an exemplary embodiment of the present disclosure.
Figure 4:
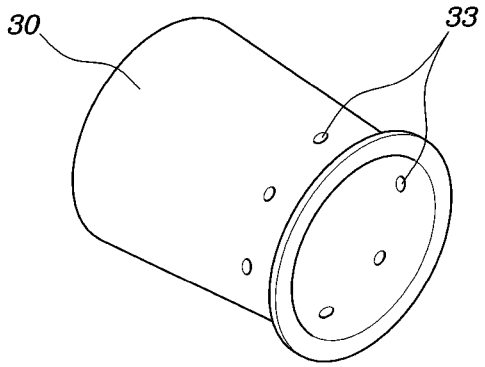
FIG. 4 is an exemplary diagram illustrating a flexible cone according to an exemplary embodiment of the present disclosure.
Figure 5:
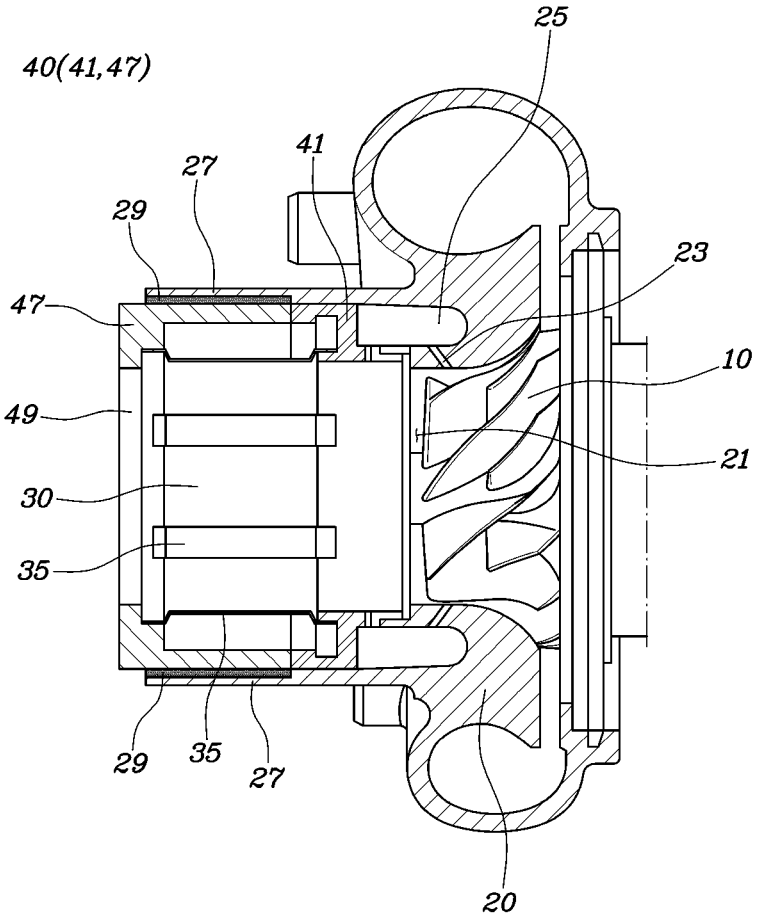
FIG. 5 is an exemplary cross-sectional view illustrating a side shape of the apparatus for suppressing a surge of a turbo compressor according to an exemplary embodiment of the present disclosure when the apparatus for suppressing a surge of a turbo compressor is not operated.
Figure 6:
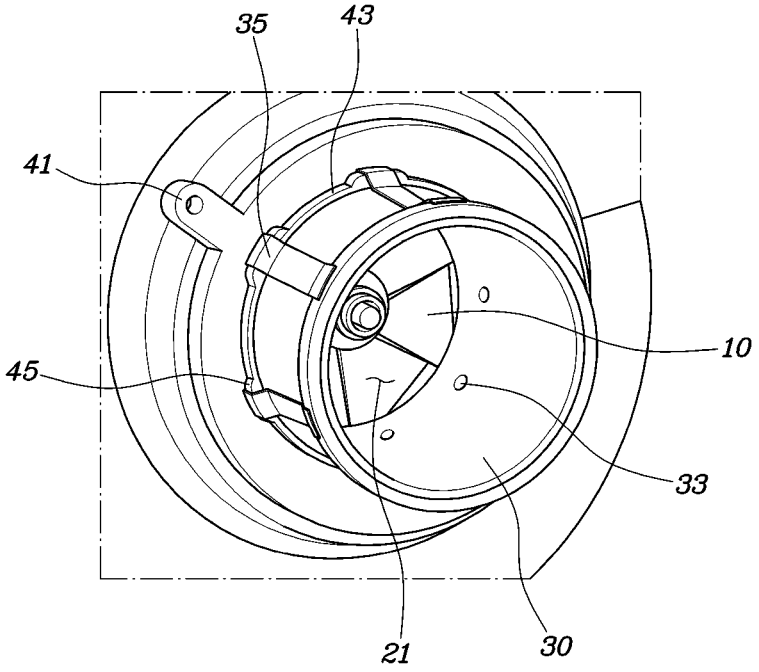
FIG. 6 is an exemplary perspective view illustrating an operation of a spring member when the apparatus for suppressing a surge of a turbo compressor according to an exemplary embodiment of the present disclosure is not operated.

Hereinafter, an apparatus for suppressing a surge of a turbo compressor according to an exemplary embodiment of the present disclosure will be described with reference to the accompanying drawings. FIG. 1 is an exemplary cross-sectional view illustrating a side shape of an apparatus for suppressing a surge of a turbo compressor according to an exemplary embodiment of the present disclosure when the apparatus for suppressing a surge of a turbo compressor is operated. FIG. 2 is an exemplary cross-sectional view illustrating an operation of a spring member when the apparatus for suppressing a surge of a turbo compressor according to an exemplary embodiment of the present disclosure is operated. FIG. 3 is an exemplary diagram illustrating a rotary member according to an exemplary embodiment of the present disclosure. FIG. 4 is an exemplary diagram illustrating a flexible cone according to an exemplary embodiment of the present disclosure. FIG. 5 is an exemplary cross-sectional view illustrating a side shape of the apparatus for suppressing a surge of a turbo compressor according to an exemplary embodiment of the present disclosure when the apparatus for suppressing a surge of a turbo compressor is not operated. FIG. 6 is an exemplary perspective view illustrating an operation of a spring member when the apparatus for suppressing a surge of a turbo compressor according to an exemplary embodiment of the present disclosure is not operated.

Referring to FIGS. 1 and 2, an apparatus for suppressing a surge of a turbo compressor according to the exemplary embodiment of the present disclosure may include a compressor housing having a compressor wheel 10 disposed therein and an inlet 21 having air flowing thereinto and protruding from a side opposite to the compressor wheel 10, a connection module 40 having a first side connected to the compressor housing 20 to communicate with the inlet 21 and a second side disposed with an inlet 49 for supplying air, a flexible cone 30 of an elastic material disposed in the connection module 40 and formed in a conical shape in which sizes of cross-sectional areas of a first side and a second side are different from each other; and a spring member 35 coupled to an exterior circumferential surface of the flexible cone 30 to provide an elastic force and operated to change a size of a cross-sectional area of the first side of the flexible cone 30.

The compressor wheel 10 may be configured to rotate to compress air introduced through the inlet 21 of the compressor housing 20 and discharge the compressed air to an intake manifold of an engine, thereby improving intake efficiency of the engine. Additionally, to supply external air to the compressor, the compressor housing 20 may include the inlet 21 protruding on the side opposite to the compressor wheel 10 to supply air to the compressor wheel 10.

According to the exemplary embodiment of the present disclosure, a first side of the flexible cone 30 having a cross-sectional area smaller than the second side, communicates with the inlet 21 of the compressor housing 20 and the second side thereof may be coupled to the inlet 49 of the connection module 40, in which a size of the cross-sectional area of the first side is less than that of the inlet 21 of the compressor housing 20. In other words, a size of a hollow portion of the flexible cone 30 may be formed to be less than that of the inlet 21 of the communicating compressor housing 20 to reduce an area of an air passage supplied to the inlet 21, thereby reducing an amount of suctioned air. Accordingly, a flow rate of air to be transmitted to the compressor wheel 10 may be adjusted, and the compressor may be effectively used even in a surge region where air is not supercharged. According to the exemplary embodiment of the present disclosure, the spring member 35 may be utilized to vary the size of the first or second side of the flexible cone 30. The operation of the spring member 35 will be described later.

According to the exemplary embodiment of the present disclosure, the compressor housing 20 may include a coupling aperture 27 that protrudes while surrounding the inlet 21 and the connection module 40 may have an exterior circumferential surface disposed in an interior side of the coupling aperture 27 of the compressor housing 20 to be connected to the compressor housing 20. In particular, in addition to the inlet 21, the coupling aperture 27, that may have a cross-sectional area greater than the cross sectional area of the inlet 21 and may be coupled with the connection module 40 is protrudedly formed on the compressor housing 20. The effect of the coupling aperture 27 will be described later.

According to the exemplary embodiment of the present disclosure, the connection module 40 may include a selectively rotatable rotary member 41 formed to have a first side and a second side having different cress-sectional areas, in which the first side having a smaller cross-sectional area that then second side may be connected to the inlet 21 of the compressor housing 20 and an exterior circumferential surface of the second side may be disposed in the coupling aperture 27, and a fixing member 47 maintaining a fixed state and having a first side selectively rotatably coupled to the second side of the rotary member 41 and the second side provided with the inlet 49. In other words, as illustrated in FIG. 3, the rotary member 41 may have a shape in which cylinders having different sectional areas are connected to each other. As illustrated in FIG. 1, a first side having a smaller cross-sectional area may be connected to the inlet 20 of the compressor housing 20, and an exterior circumferential surface of the second side having a relatively greater cross-sectional area may be disposed in an interior circumferential surface of the coupling aperture 27.

Additionally, although not illustrated, the rotary member 41 may be connected to the compressor housing 20 via a connecting device via a separate bearing or may be disposed in the compressor housing 20 with a tolerance to be selectively rotatable with respect to the compressor housing 20. The rotary member 41 may be configured to be rotatably operated by a separately provided actuator. The fixing member 47 may couple the flexible cone 30. The fixing member 47 may be coupled to the rotary member 41 via a bearing or may communicate with each other with a tolerance to prevent a torque from the rotary member 41 from being received. In addition, a sealing member 29 may be disposed between the exterior circumferential surface of the fixing member 47 and the interior side surface of the coupling aperture 27. Therefore, the fixing member 47 may be coupled to the compressor housing 20 and foreign substances or external air may be prevented from flowing into the cavity between the fixing member 47 and the compressor housing 20.

According to the exemplary embodiment of the present disclosure, the rotary member 41 may include a locking portion 43 to lock a first end of the spring member 35, a second end of the spring member 35 may be coupled to the inlet 49 of the fixing member 30 together with the flexible cone 30, and the intermediate part thereof may be coupled to the exterior circumferential surface of the flexible cone 30. Specifically, the locking portion 43 may protrude in a second side direction from the part where the difference in the cross-sectional areas occurs between the first side and the second side of the rotary member 41.

The locking portion 43 of the rotary member 41 includes the protrusion 45 protruding in a radial direction, and thus when a first end of the spring member 35 is expanded (e.g., stretched) while being positioned at the protrusion by the rotation of the rotary member 41, the cross-sectional area of a first side of the flexible cone 30 may be equal to that of the inlet 21 of the compressor housing 20. The protrusion 45 may be provided in plural, and thus the plurality of protrusions 45 may protrude while being spaced apart from each other at a predetermined distance along the locking portion 43.

As illustrated in FIG. 2, the elastic spring 35, which provides an elastic force to vary the shape of the flexible cone 30, may include a first end locked to the locking portion 43 formed at a first end of the rotary member 40, and a second end fixed to the fixing member 47. When the rotary member 40 rotates to lock a first end of the elastic spring 35 to a part where the protrusion 45 is not formed, as illustrated in FIG. 1, the elastic spring 35 may be compressed to an original state to maintain an original shape in which the cross-sectional area of a first side of the flexible cone 30 may be less than that of the inlet 21. Accordingly, this increases a surge margin of the compressor. When the rotary member 40 rotates to lock a first end of the elastic spring 35 to the protrusion 45 as illustrated in FIG. 6, the elastic spring 35 may be expanded to a first side of the variable cone 30 as illustrated in FIG. 2. The cross-sectional area of the elastic spring 35 may be equal to that of the inlet 21 of the compressor housing 20. Therefore, the amount of air supplied to the inlet 21 of the compressor housing 20 may be increased.

The compressor housing 20 that includes the apparatus for suppressing a surge of a turbo compressor according to the exemplary embodiment of the present disclosure may include a first aperture 23 disposed on a side wall thereof on which the inlet 21 is formed and guide air on the compressor wheel 10 side to a chamber 25 formed by the coupling aperture 27 and the rotary member 41. The exterior circumferential surface of the rotary member 41 may include a second aperture 42. The exterior circumferential surface of the flexible cone 30 may include with a third aperture 23, thereby re-circulating the air introduced into the inlet 21. When the rotary member 41 rotates to engage a first end portion of the spring member 35 with the locking portion 43 where the protrusion 45 is not formed, the shape of the flexible cone 30 may be restored to an original position. Accordingly, the cross-sectional area of a first side of the flexible cone 30 relative to the area of the inlet 21 of the compressor housing 20 may be reduced. The inflow air flows backward due to the step formed at a first side of the flexible cone 30 and at the inlet 21 side of the compressor housing 20.

Accordingly, as illustrated in FIG. 1, the first aperture 23 may be formed on the side wall of the inlet 21 of the compressor housing 20 in which the backflow phenomenon occurs, and air may be introduced into the chamber 25 including the inlet 21, the coupling aperture 27, and the rotary member 41. As illustrated in FIGS. 1 and 3, the air introduced into the chamber 25 may be introduced into the hollow portion of the flexible cone 30 via the second aperture 42 formed on the exterior circumferential surface of the rotary member 41 and the third aperture 33 formed on the exterior circumferential surface of the flexible cone 30 as illustrated in FIGS. 1 and 4. Therefore, the air that has flowed back from the inlet 21 side of the compressor housing 20 may be re-circulated back to the inlet 21, thereby preventing a flow loss or a specific noise from occurring due to the backflow phenomenon.

The second aperture 42 of the rotary member 41 and the third aperture 33 of the flexible cone 30 may not be aligned with each other. As illustrated in FIG. 5, when the rotary member 41 is operated to expand the spring member 35 the flexible cone 30 and the rotary member 41 may be provided to be coupled to each other while the third aperture 33 formed in the flexible cone 30 and the second aperture 42 formed in the rotary member 41 are not aligned with each other. Accordingly, the air flow is unnecessarily re-circulated when the backflow phenomenon does not occur, thereby preventing the flow efficiency from reducing.

According to the apparatus for suppressing a surge of a turbo compressor having the structure as described above, the passage area of air introduced into the compressor inlet of the turbocharger may be variably adjusted to adjust the flow rate introduced into the compressor to prevent the surge phenomenon from occurring and secure the surge margin. Accordingly, the marketability of the turbocharger may be improved. Further, when the backflow phenomenon occurs when the air passage area at the compressor is narrow, the backflow air may be recovered and re-circulated, thereby preventing the efficiency of the turbocharger from deteriorating.

Although the present disclosure has been shown and described with respect to exemplary embodiments, it will be obvious to those skilled in the art that the present disclosure may be variously modified and altered without departing from the spirit and scope of the present disclosure as defined by the following claims.

What is claimed is:

1. An apparatus for suppressing a surge of a turbo compressor, comprising:

a compressor housing having a compressor wheel disposed in the compressor housing and an inlet configured to introduce air flowing into the compressor housing, and the inlet protrudes in a direction opposite to the compressor wheel;

a connection module having a first side connected to the compressor housing to communicate with the inlet of the compressor housing and a second side having an intake hole for supplying air;

a flexible cone of an elastic material disposed in the connection module and formed in a conical shape, wherein the flexible cone has a first side and a second side, wherein a size of a cross-sectional area of the first side of the flexible cone is different from a size of a cross-sectional area of the second side of the flexible cone; and a spring member coupled to an exterior circumferential surface of the flexible cone to provide an elastic force and operated to change a size of at least one of the cross-sectional area of the first side of the flexible cone and the cross-sectional area of the second side of the flexible cone, wherein the cross-sectional area of the first side of the flexible cone is smaller than the cross-sectional area of the second side of the flexible cone, wherein the first side of the flexible cone communicates with the inlet of the compressor housing and the second side of the flexible cone is coupled to the intake hole of the connection module, and the cross-sectional area of the first side of the flexible cone is smaller than a cross-sectional area of the inlet of the compressor housing, wherein the compressor housing includes a coupling aperture that protrudes while surrounding the inlet of the compressor housing, and the connection module has an exterior circumferential surface disposed in an interior side of the coupling aperture of the compressor housing and connected to the compressor housing, wherein the connection module includes:

a selectively rotatable rotary member formed to have a first side and a second side having different cross-sectional areas, wherein the cross-sectional area of the first side of the rotary member is smaller than the cross-sectional area of the second side of the rotary member, wherein the first side of the rotary member is coupled to the inlet of the compressor housing and an exterior circumferential surface of the second side of the rotary member is disposed in the coupling aperture; and a fixing member having a first side and a second side, wherein the first side of the fixing member is coupled to the second side of the rotary member to be relatively rotatable, and the second side of the fixing member includes the intake hole of the connection module, and wherein the rotary member includes a locking portion to lock a first end of the spring member, a second end of the spring member is coupled to the intake hole of the connection module together with the flexible cone, and an intermediate portion of the spring member is coupled to the exterior circumferential surface of the flexible cone.

2. The apparatus of claim 1, wherein the locking portion of the rotary member includes a protrusion protruding in a radial direction, wherein when the first end of the spring member is expanded while being positioned at the protrusion by rotation of the rotary member, the cross-sectional area of the first side of the flexible cone expands to be equal to the cross-sectional area of the inlet of the compressor housing.

3. The apparatus of claim 2, wherein the compressor housing includes a first aperture disposed on a side wall forming the inlet of the compressor housing and is configured to guide air on the compressor wheel side to a chamber formed from the coupling aperture and the rotary member, an exterior circumferential surface of the rotary member is formed with a second aperture, and the exterior circumferential surface of the flexible cone is formed with a third aperture to re-circulate air.

4. The apparatus of claim 3, wherein the second aperture of the rotary member and the third aperture of the flexible cone are misaligned from each other.

5. The apparatus of claim 1, wherein a sealing member is disposed between an exterior circumferential surface of the fixing member and an interior side surface of the coupling aperture.

* * * * *